US010855014B1

(12) United States Patent
Wu

(10) Patent No.: US 10,855,014 B1
(45) Date of Patent: Dec. 1, 2020

(54) CONNECTOR USED WITH HIGH-CURRENT TERMINAL

(71) Applicants: DINKLE ENTERPRISE CO., LTD., New Taipei (TW); DINKLE ELECTRIC MACHINERY (CHINA) CO., LTD., Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Jiangsu (CN)

( * ) Notice: Subject to any disclaimer, the term of this patent is extended or adjusted under 35 U.S.C. 154(b) by 0 days.

(21) Appl. No.: 16/511,208

(22) Filed: Jul. 15, 2019

(51) Int. Cl.

| | |
|---|---|
| ***H01R 3/00*** | (2006.01) |
| ***H01R 13/193*** | (2006.01) |
| ***H01R 25/14*** | (2006.01) |
| ***H01R 13/53*** | (2006.01) |
| ***H01R 13/05*** | (2006.01) |

(52) U.S. Cl.
CPC ..... *H01R 13/193* (2013.01); *H01R 13/05* (2013.01); *H01R 13/53* (2013.01); *H01R 25/142* (2013.01)

(58) Field of Classification Search
CPC ... H01R 12/737; H01R 13/055; H01R 13/035
USPC ..... 439/62, 851
See application file for complete search history.

(56) References Cited

U.S. PATENT DOCUMENTS 4,781,612 A * 11/1988 Thrush ..... H01R 12/716 439/328
4,995,825 A * 2/1991 Korsunsky ..... H01R 12/7005 439/326
5,156,554 A * 10/1992 Rudoy ..... H01R 13/6471 439/108

(Continued)

FOREIGN PATENT DOCUMENTS

| | | | |
|---|---|---|---|
| CN | 110011100 | A | 7/2019 |
| DE | 102012001560 | A1 | 8/2013 |
| DE | 102014005535 | A1 | 10/2015 |

OTHER PUBLICATIONS

Office Action dated Mar. 13, 2020 of the corresponding German patent application.

*Primary Examiner* — Abdullah A Riyami
*Assistant Examiner* — Nelson R. Burgos-Guntin
(74) *Attorney, Agent, or Firm* — Chun-Ming Shih; HDLS IPR Services

(57) ABSTRACT

A connector (10) used with a high-current terminal (100) includes a main body (1) and a conductive spacer (2). The main body (1) has a connecting portion (11) disposed at one end thereof and a pluggable portion (12) disposed at the other end thereof. The high-current terminal (100) is plugged into the pluggable portion (12). The conductive spacer (2) is disposed between the pluggable portion (12) and the high-current terminal (100). The conductive spacer (2) has a plurality of outer projections (21) pressed against the pluggable portion (12) and a plurality of inner projections (22) pressed against the high-current terminal (100).

(Continued)

Thus, the number of electrical contact points is increased by means of the outer projections (21) and the inner projections (22) disposed between the pluggable portion (12) and the high-current terminal (100) such that the connector (10) has excellent electric conductivity and current adjustment capability.

11 Claims, 12 Drawing Sheets

(56) References Cited

U.S. PATENT DOCUMENTS 5,496,182 A * 3/1996 Yasumura ..... H01R 12/62 439/62
5,505,626 A * 4/1996 Grabbe ..... H01R 12/71 439/62
5,582,519 A * 12/1996 Buchter ..... H01R 23/688 439/101
5,676,559 A * 10/1997 Laub ..... H01R 12/62 439/260
6,036,519 A * 3/2000 Lopata ..... H01R 12/716 439/260
6,296,519 B1 * 10/2001 Hashizawa ..... H01R 13/6599 439/607.42
6,347,950 B1 * 2/2002 Yokoyama ..... H01R 13/6315 439/248
6,402,525 B2 * 6/2002 Gugliotti ..... H01R 12/7088 439/62
6,482,049 B1 * 11/2002 Swearingen ..... H01R 4/4881 439/843
6,488,549 B1 * 12/2002 Weller ..... H01R 13/6485 439/181
6,890,214 B2 * 5/2005 Brown ..... H01R 12/725 439/607.05
7,011,548 B2 * 3/2006 Bogiel ..... H01R 12/727 439/247
7,083,433 B2 * 8/2006 Misawa ..... H01R 12/7088 439/80
7,476,108 B2 * 1/2009 Swain ..... G06F 1/20 439/487
7,613,011 B2 * 11/2009 Grundy ..... H01R 12/7082 361/736
8,808,039 B2 * 8/2014 Mott ..... B60L 53/31 439/843
8,839,513 B2 * 9/2014 Nakamura ..... G01D 1/00 29/876
9,711,897 B2 * 7/2017 Ho ..... H01R 13/631
10,230,191 B2 * 3/2019 Lui ..... H01R 13/052
2002/0028588 A1 * 3/2002 Watanabe ..... H01R 12/721 439/62
2002/0049006 A1 * 4/2002 Zhao ..... H01R 11/22 439/843
2004/0048496 A1 * 3/2004 Chi ..... H01R 12/716 439/62
2006/0014442 A1 1/2006 Allgood et al.
2007/0123084 A1 * 5/2007 Takehara ..... H01R 13/187 439/268
2007/0155194 A1 * 7/2007 Vega Martinez ..... H05K 1/142 439/62
2011/0111606 A1 * 5/2011 Lee ..... H01R 12/613 439/62
2012/0156947 A1 6/2012 Tyler
2019/0044267 A1 2/2019 Lui et al.

* cited by examiner

CONNECTOR USED WITH HIGH-CURRENT TERMINAL

BACKGROUND OF THE INVENTION

Field of the Invention

The present invention relates to a connector structure and in particular to a connector which is used with a high-current terminal.

Description of Prior Art

A connector used with a high-current terminal is currently available in the market, which is used to connect the bus bar of the network energy equipment, unit base, servers, internet equipment, or industrial power distribution equipment to the circuit board. However, the connector used with the high-current terminal usually has the problems of insufficient electric conductivity and incapability of current adjustment.

In view of this, the inventor pays special attention to research with the application of related theory and tries to improve and overcome the above disadvantages regarding the above related art, which becomes the development goal of the inventor.

SUMMARY OF THE INVENTION

The present invention provides a connector used with a high-current terminal to increase the number of electrical contact points by means of plural outer projections and plural inner projections disposed between the pluggable portion and the high-current terminal such that the connector has excellent electric conductivity and current adjustment capability.

In the embodiments, the present invention provides a connector used with a high-current terminal. The connector comprises a main body and a conductive spacer. The main body has a connecting portion disposed at one end thereof and a pluggable portion disposed at the other end thereof; the high-current terminal is plugged into the pluggable portion. The conductive spacer is disposed between the pluggable portion and the high-current terminal; the conductive spacer has a plurality of outer projections pressed against the pluggable portion and a plurality of inner projections pressed against the high-current terminal.

According to the above description, the number of electrical contact points is increased by means of the outer projections and the inner projections disposed between the pluggable portion and the high-current terminal. The current flowing through the pluggable portion can be adjusted by adjusting the numbers of the outer projections and the inner projections such that the connector has excellent electric conductivity and current adjustment capability.

According to the above description, because the shapes of the outer projection and the inner projection generate spring force, the holding force of the pluggable portion on the high-current terminal can be adjusted by adjusting the spring force of the outer bent projections and the inner bent projections disposed between the pluggable portion and the high-current terminal.

DETAILED DESCRIPTION OF THE INVENTION

The technical features and details of the present invention are described below in reference to accompanying figures. However, the accompanying figures are only for reference and explanation, but not to limit the scope of the present invention.

Please refer to FIGS. 1-4. The present invention provides a connector used with a high-current terminal. The connector 10 mainly comprises a main body 1 and a conductive spacer 2. The connector 10 and the conductive spacer shown in FIGS. 1-4 belong to the first embodiment of the present invention.

Figure 1:
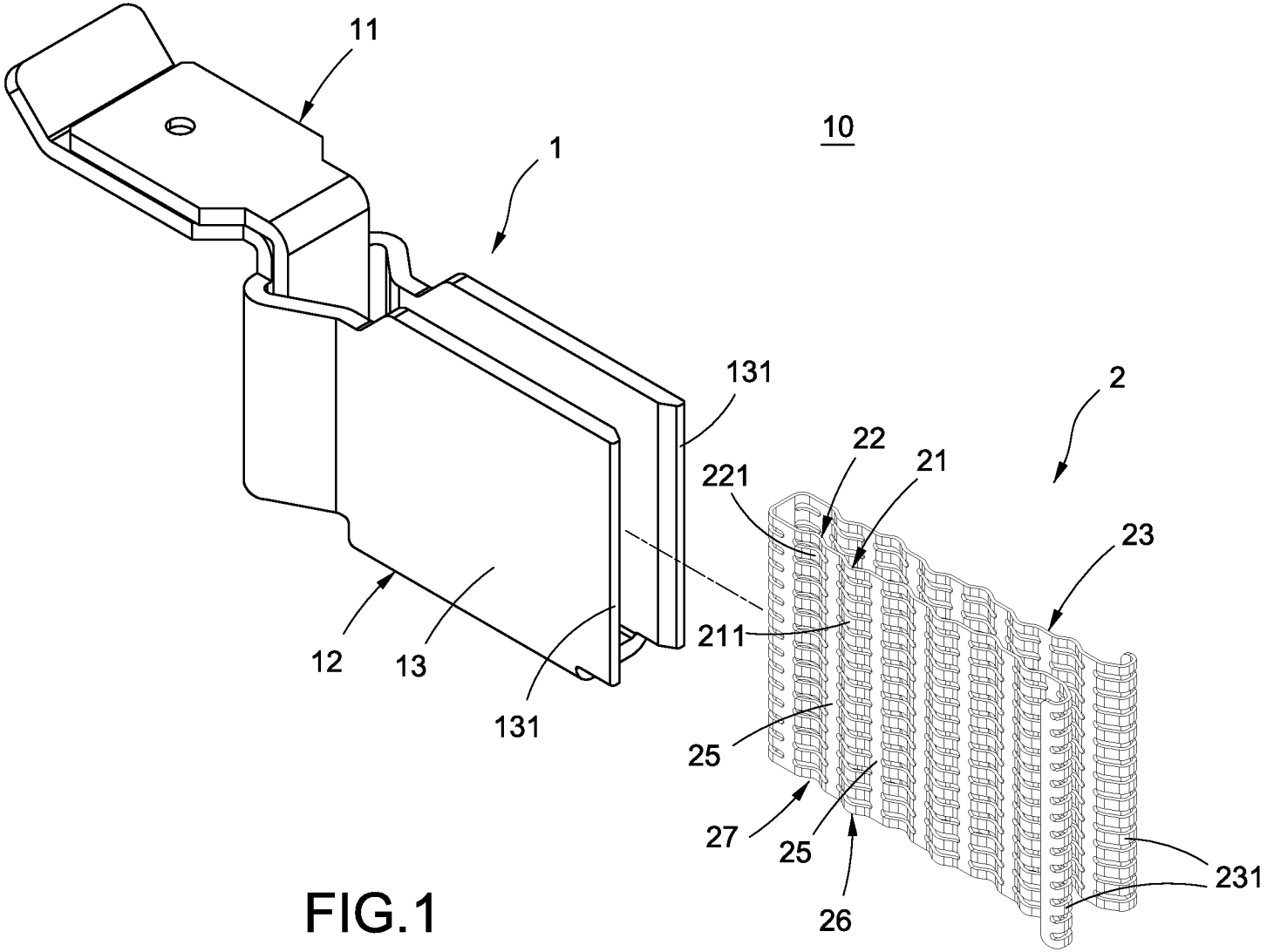
FIG. 1 is a perspective exploded view of the connector according to the first embodiment of the present invention.
Figure 2:
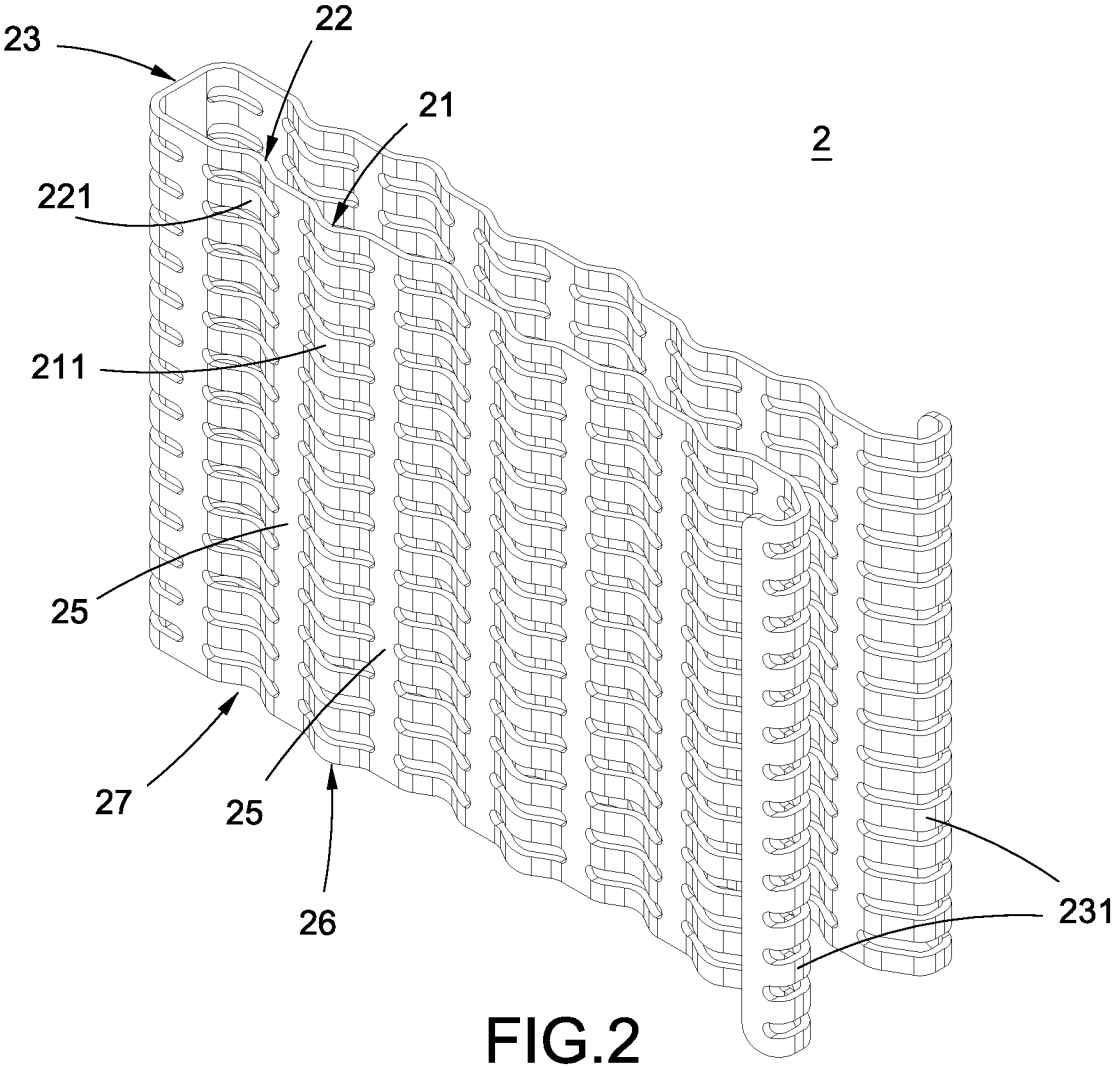
FIG. 2 is a perspective schematic view of the conductive spacer according to the first embodiment of the present invention.
Figure 3:
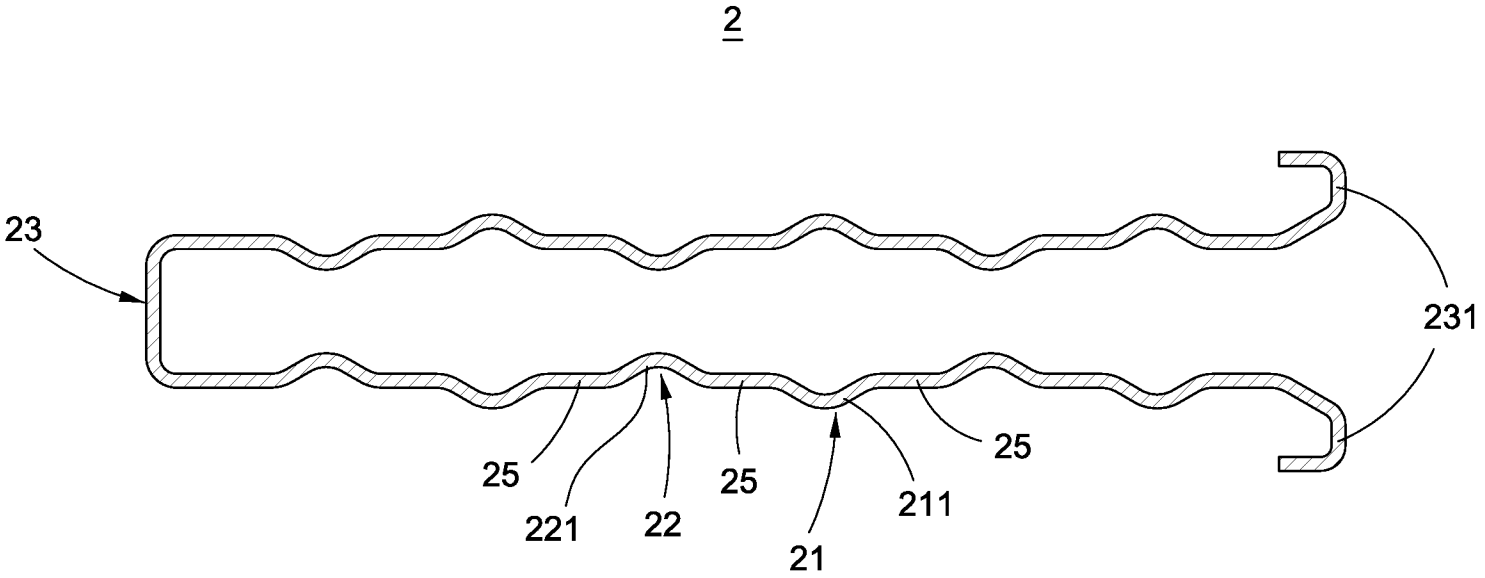
FIG. 3 is a cross-sectional view of the conductive spacer according to the first embodiment of the present invention.
Figure 4:
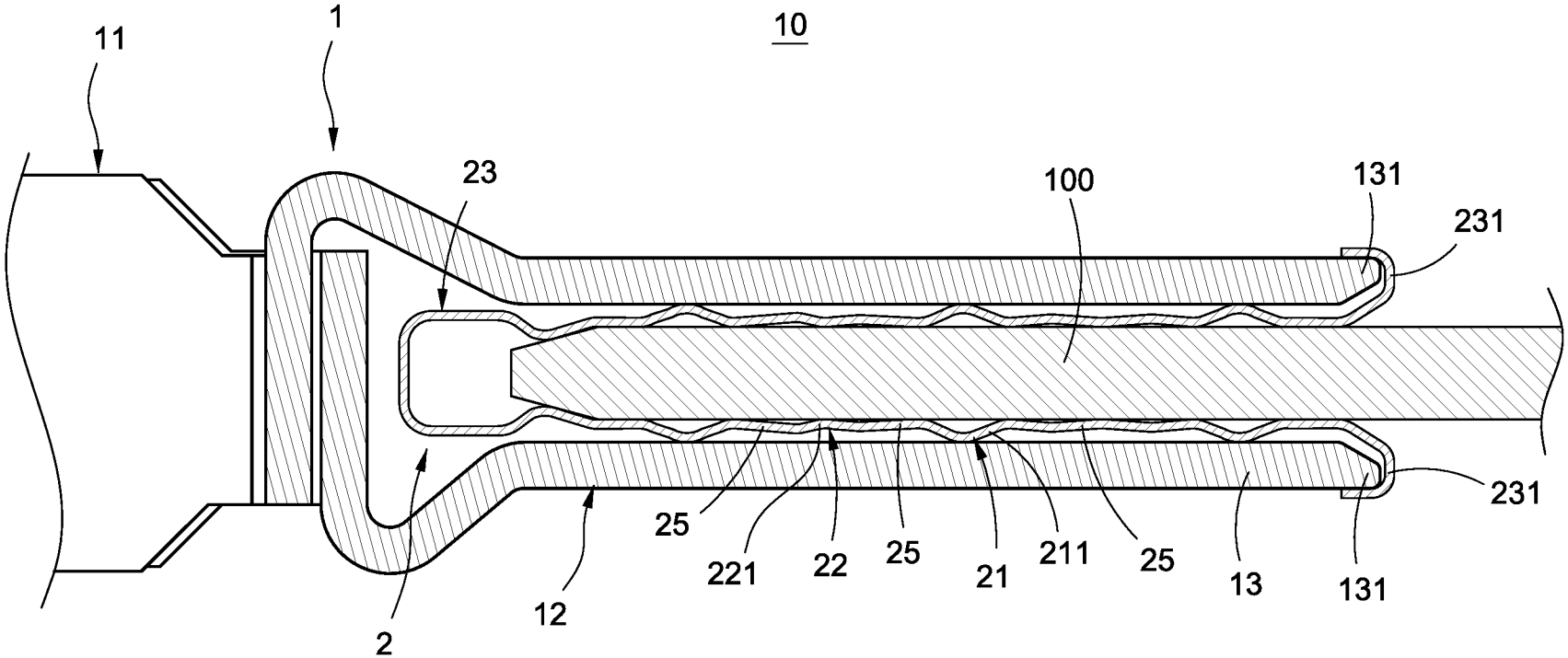
FIG. 4 is an operational view of the connector according to the first embodiment of the present invention.

As shown in FIGS. 1 and 4, the main body 1 is made of metal. The main body 1 has a connecting portion 11 disposed at one end thereof and a pluggable portion 12 disposed at the other end thereof. The high-current terminal 100 is plugged into the pluggable portion 12. The connecting portion 11 is used to be electrically connected to the bus bar.

As shown in FIGS. 1-4, the conductive spacer 2 is made of metal. The conductive spacer 2 is disposed between the pluggable portion 12 and the high-current terminal 100. The conductive spacer 2 has a plurality of outer projections 21 pressed against the pluggable portion 12 and a plurality of inner projections 22 pressed against the high-current terminal 100.

The details are given below. The conductive spacer 2 has a plurality of flat portions 25 disposed longitudinally and in parallel, a plurality of first sections 26, and a plurality of second sections 27; the first sections 26 and the second sections 27 are interlaced with each other and disposed between the flat portions 25. The outer projections 21 are a plurality of outer bent projections 211 which are formed in the first sections 26 and integrally connected between the flat portions 25; the inner projections 22 are a plurality of inner bent projections 221 which are formed in the second sections 27 and integrally connected between the flat portions 25.

In addition, in the current embodiment, the pluggable portion 12 is a U-shaped clamp 13 which has two end edges 131 disposed in parallel with each other. The conductive spacer 2 is a U-shaped sheet body 23 fitting the U-shaped clamp 13. The U-shaped sheet body 23 has two ends which are bent to form two hook portions 231 surrounding and pressing against the two end edges 131 such that the conductive spacer 2 can be fixed firmly to the pluggable portion 12.

FIGS. 1 and 4 show the operational state of the connector 10 of the present invention in which the conductive spacer 2 is disposed between the pluggable portion 12 and the high-current terminal 100 and has a plurality of outer projections 21 pressed against the pluggable portion 12 and a plurality of inner projections 22 pressed against the high-current terminal 100. In this way, the number of electrical contact points between the pluggable portion 12 and the high-current terminal 100 is increased by means of the outer projections 21 and the inner projections 22. Also, the current flowing through the pluggable portion 12 can be adjusted by adjusting the numbers of the outer projections 21 and the inner projections 22 such that the connector 10 has excellent electric conductivity and current adjustment capability.

Moreover, the outer projections 21 are composed of a plurality of outer bent projections 211; the inner projections 22 are composed of a plurality of inner bent projections 221. Because the shapes of the outer bent projections 211 and the inner bent projections 221 generate spring force, the holding force of the pluggable portion 12 on the high-current terminal 100 can be adjusted by adjusting the spring force of the outer bent projections 211 and the inner bent projections 221 disposed between the pluggable portion 12 and the high-current terminal 100.

Figure 5:
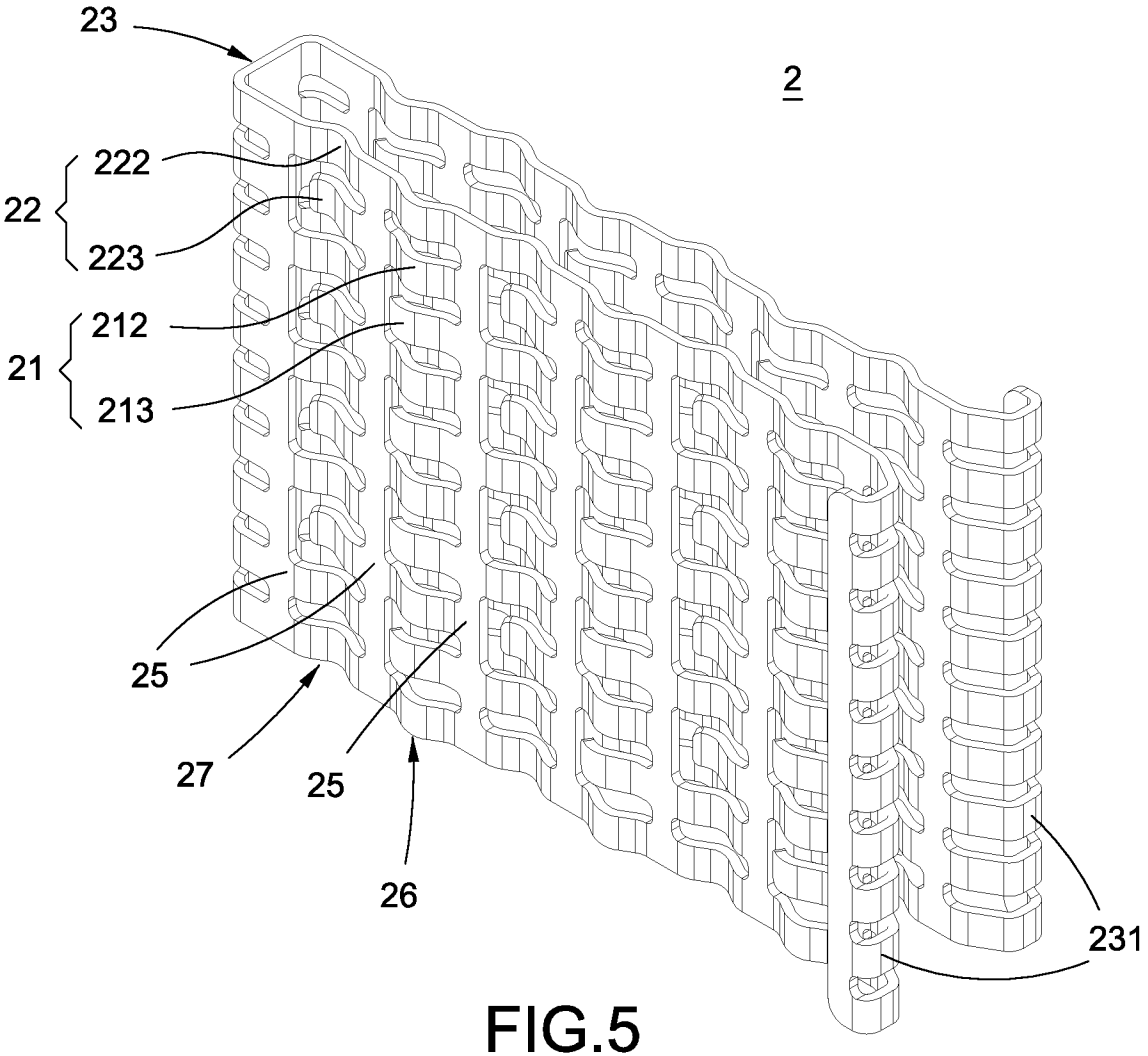
FIG. 5 is a perspective schematic view of the conductive spacer according to the second embodiment of the present invention.
Figure 6:
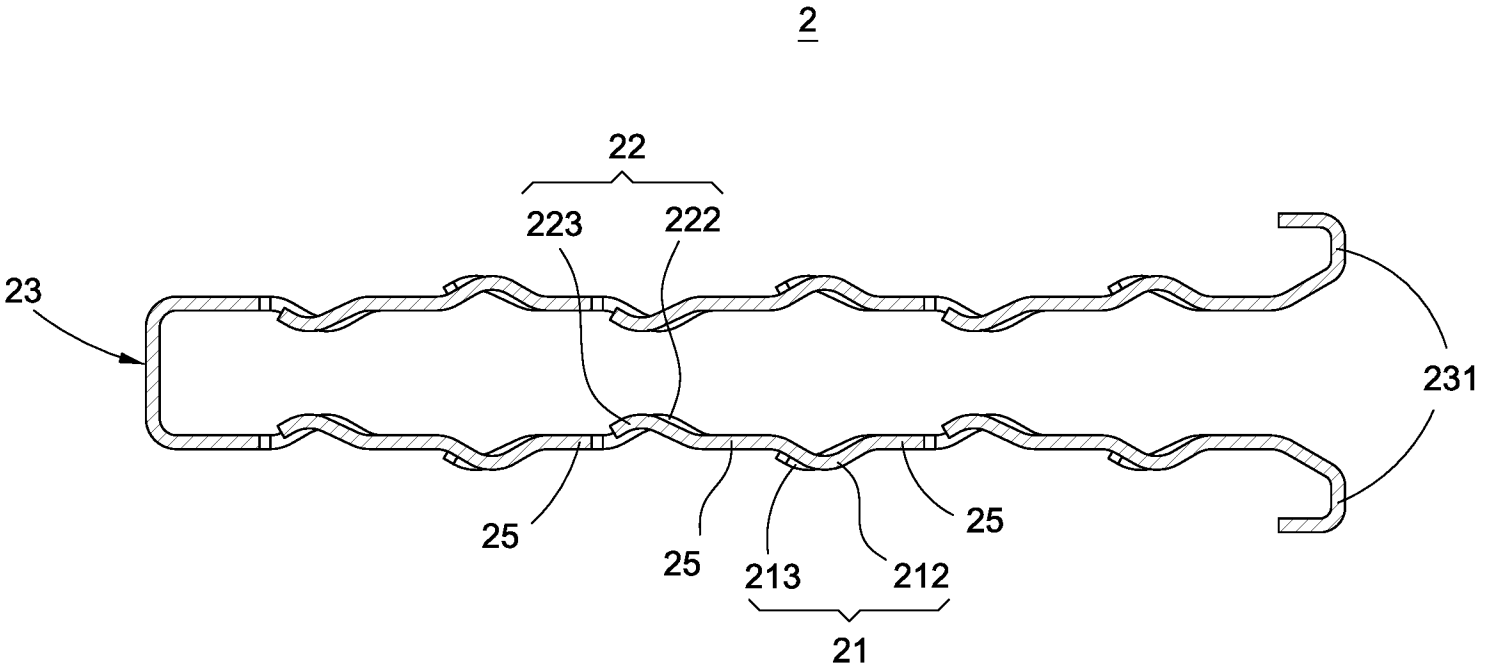
FIG. 6 is a cross-sectional view of the conductive spacer according to the second embodiment of the present invention.

Please refer to FIGS. 5 and 6, which show the connector 10 and the conductive spacer 2 according to the second embodiment of the present invention. The second embodiment is similar to the first embodiment. The difference between the first and the second embodiments is that the conductive spacers 2 of these two embodiments have different structures.

The further description is given below. The outer projections 21 comprise a plurality of first outer bent projections 212 which are formed in the first sections 26 and are integrally connected between the flat portions 25 and a plurality of second outer bent projections 213 which are formed in the first sections 26 and extend from a side of the flat portions 25. The inner projections 22 comprise a plurality of first inner bent projections 222 which are formed in the second sections 27 and integrally connected between the flat portions 25 and a plurality of second inner bent projections 223 which are formed in the second sections 27 and extend from a side of the flat portions 25. The first outer bent projections 212 and the second outer bent projections 213 are interlaced with each other; the first inner bent projections 222 and the second inner bent projections 223 are interlaced with each other. In this way, the shapes of the first outer bent projections 212, the second outer bent projections 213, the first inner bent projections 222, and the second inner bent projections 223 generate spring force, which have the same function and effect as the first embodiment.

Figure 7:
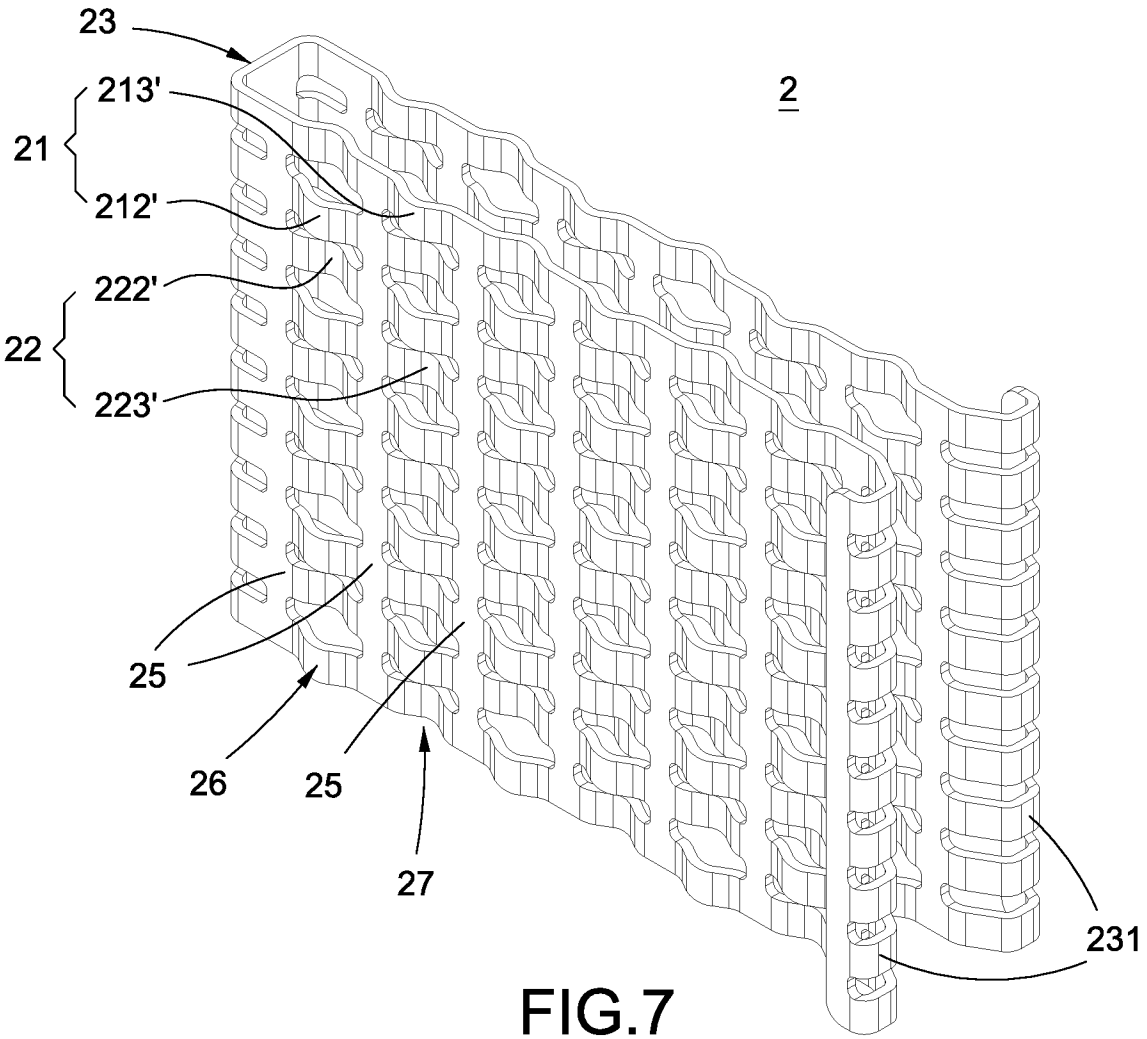
FIG. 7 is a perspective schematic view of the conductive spacer according to the third embodiment of the present invention.
Figure 8:
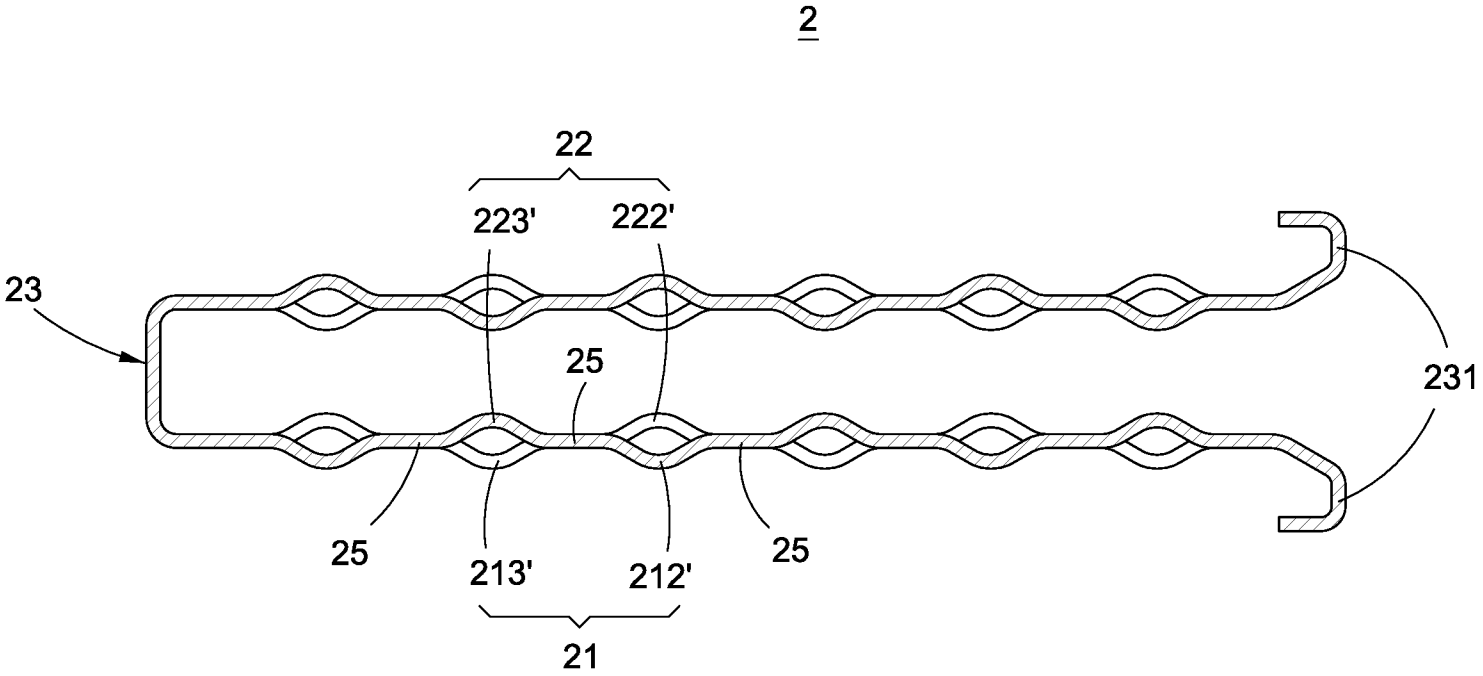
FIG. 8 is a cross-sectional view of the conductive spacer according to the third embodiment of the present invention.

Please refer to FIGS. 7 and 8, which show the connector 10 and the conductive spacer 2 according to the third embodiment of the present invention. The third embodiment is similar to the first embodiment. The difference between the first and the third embodiments is that the conductive spacers 2 of these two embodiments have different structures.

The detailed description is given below. The outer projections 21 comprise a plurality of first outer bent projections 212' which are formed in the first sections 26 and integrally connected between the flat portions 25 and a plurality of second outer bent projections 213' which are formed in the second sections 27 and integrally connected between the flat portions 25. The inner projections 22 comprise a plurality of first inner bent projections 222' which are formed in the first sections 26 and integrally connected between the flat portions 25 and a plurality of second inner bent projections 223' which are formed in the second sections 27 and integrally connected between the flat portions 25. The first outer bent projections 212' and the first inner bent projections 222' are interlaced with each other; the second outer bent projections 213' and the second inner bent projections 223' are interlaced with each other. In this way, the shapes of the first outer bent projections 212', the second outer bent projections 213', the first inner bent projections 222', and the second inner bent projections 223' generate spring force, which have the same function and effect as the first embodiment.

Figure 9:
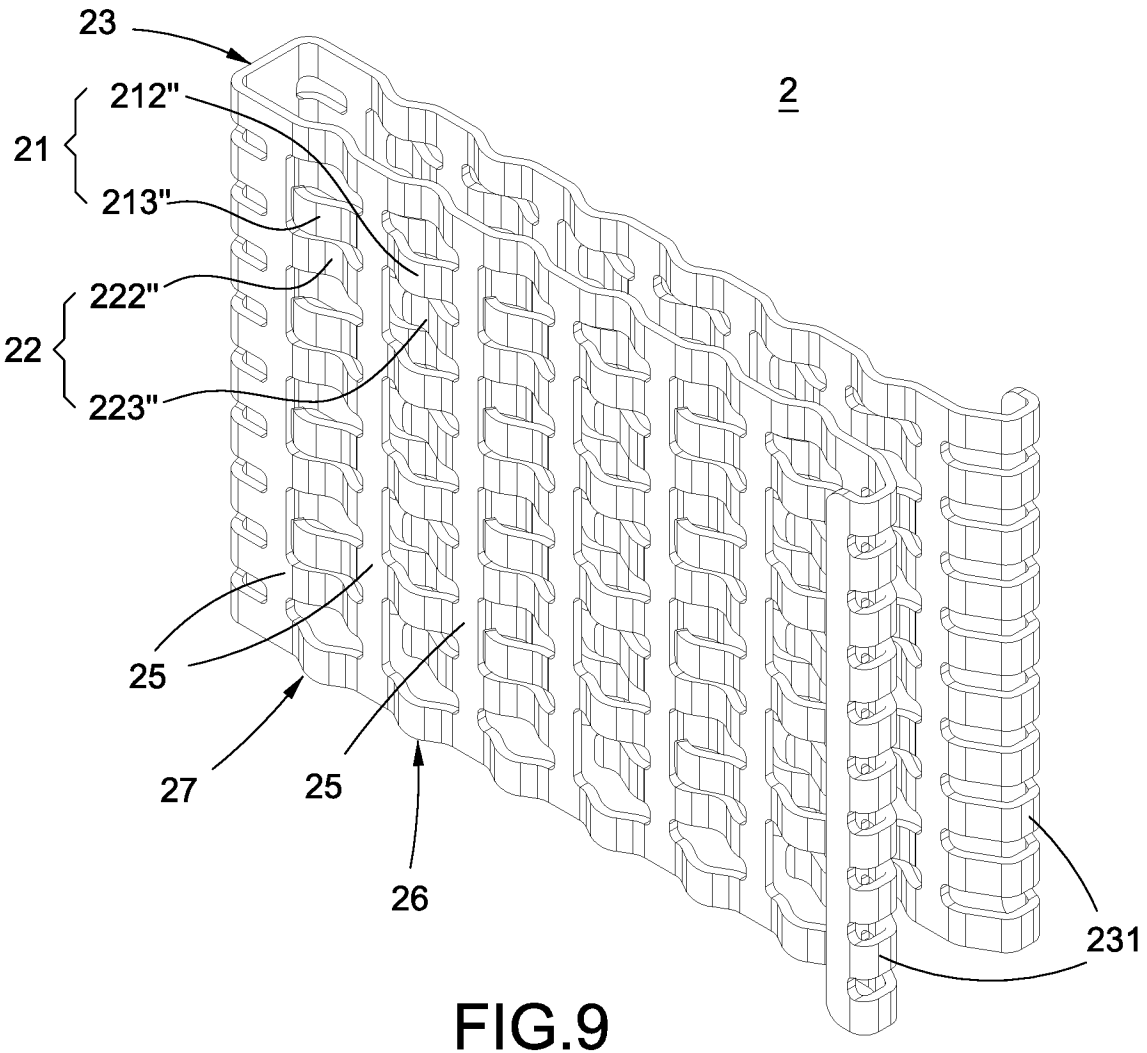
FIG. 9 is a perspective schematic view of the conductive spacer according to the fourth embodiment of the present invention.
Figure 10:
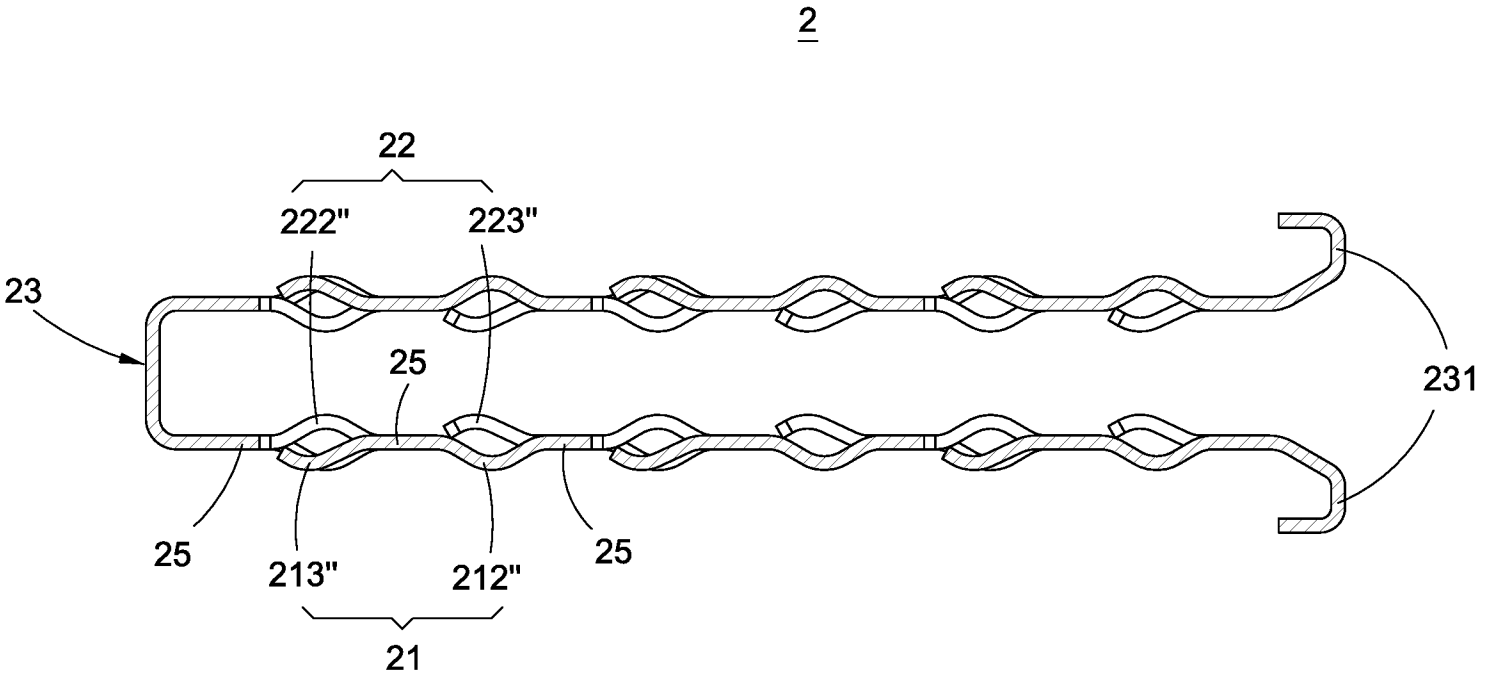
FIG. 10 is a cross-sectional view of the conductive spacer according to the fourth embodiment of the present invention.

Please refer to FIGS. 9 and 10, which show the connector 10 and the conductive spacer 2 according to the fourth embodiment of the present invention. The fourth embodiment is similar to the first embodiment. The difference between the first and the fourth embodiments is that the conductive spacers 2 of these two embodiments have different structures.

The further description is given below. The outer projections 21 comprise a plurality of first outer bent projections 212" which are formed in the first sections 26 and integrally connected between the flat portions 25 and a plurality of second outer bent projections 213" which are formed in the second sections 27 and extend from a side of the flat portions 25. The inner projections 22 comprise a plurality of first inner bent projections 222" which are formed in the first sections 26 and extend from a side of the flat portions 25 and a plurality of second inner bent projections 223" which are formed in the second sections 27 and integrally connected between the flat portions 25. The first outer bent projections 212" and the first inner bent projections 222" are interlaced with each other; the second outer bent projections 213" and the second inner bent projections 223" are interlaced with each other. In this way, the shapes of the first outer bent projections 212", the second outer bent projections 213", the first inner bent projections 222", and the second inner bent projections 223" generate spring force, which have the same function and effect as the first embodiment.

Figure 11:
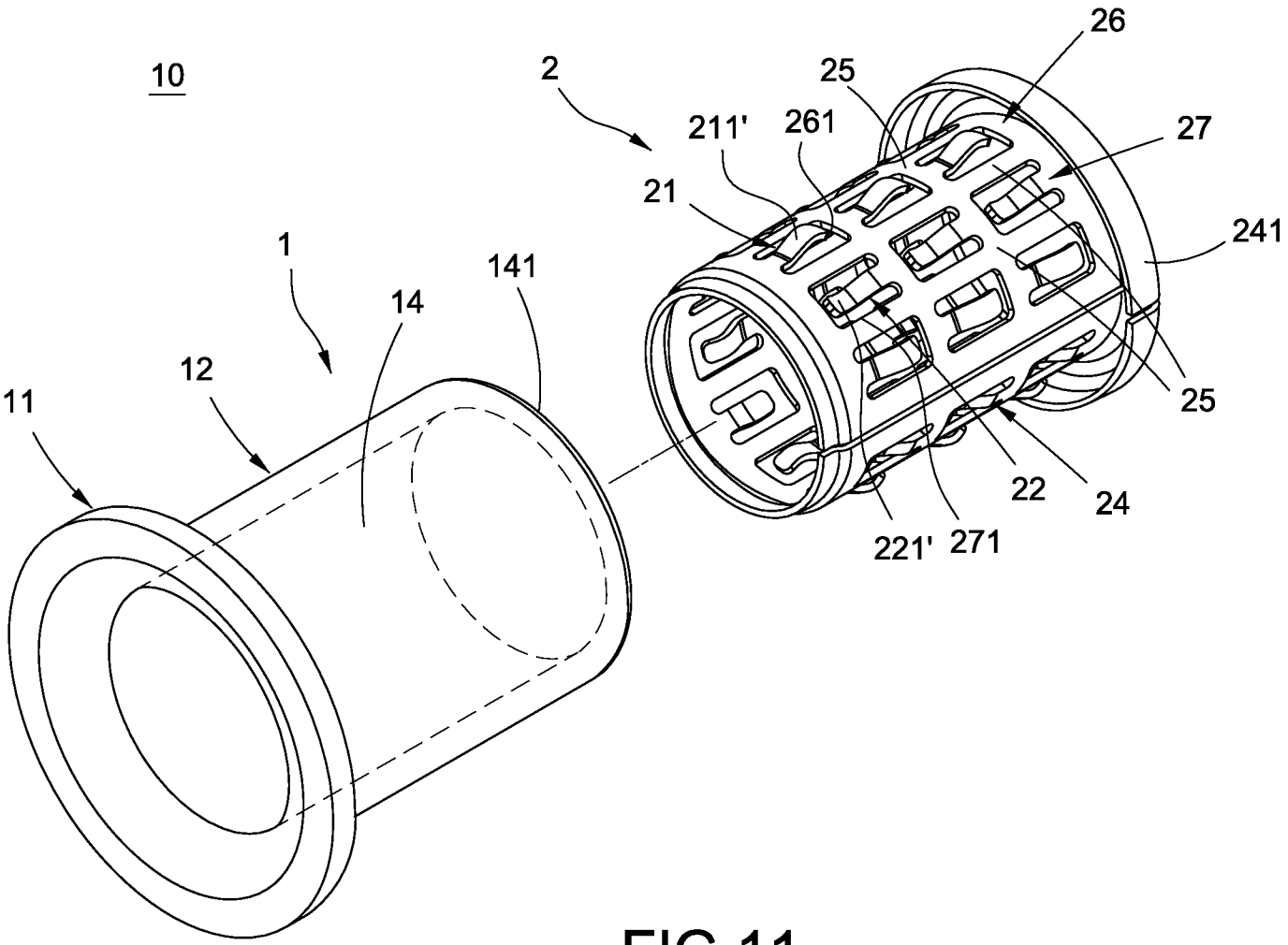
FIG. 11 is a perspective exploded view of the connector according to the fifth embodiment of the present invention.
Figure 12:
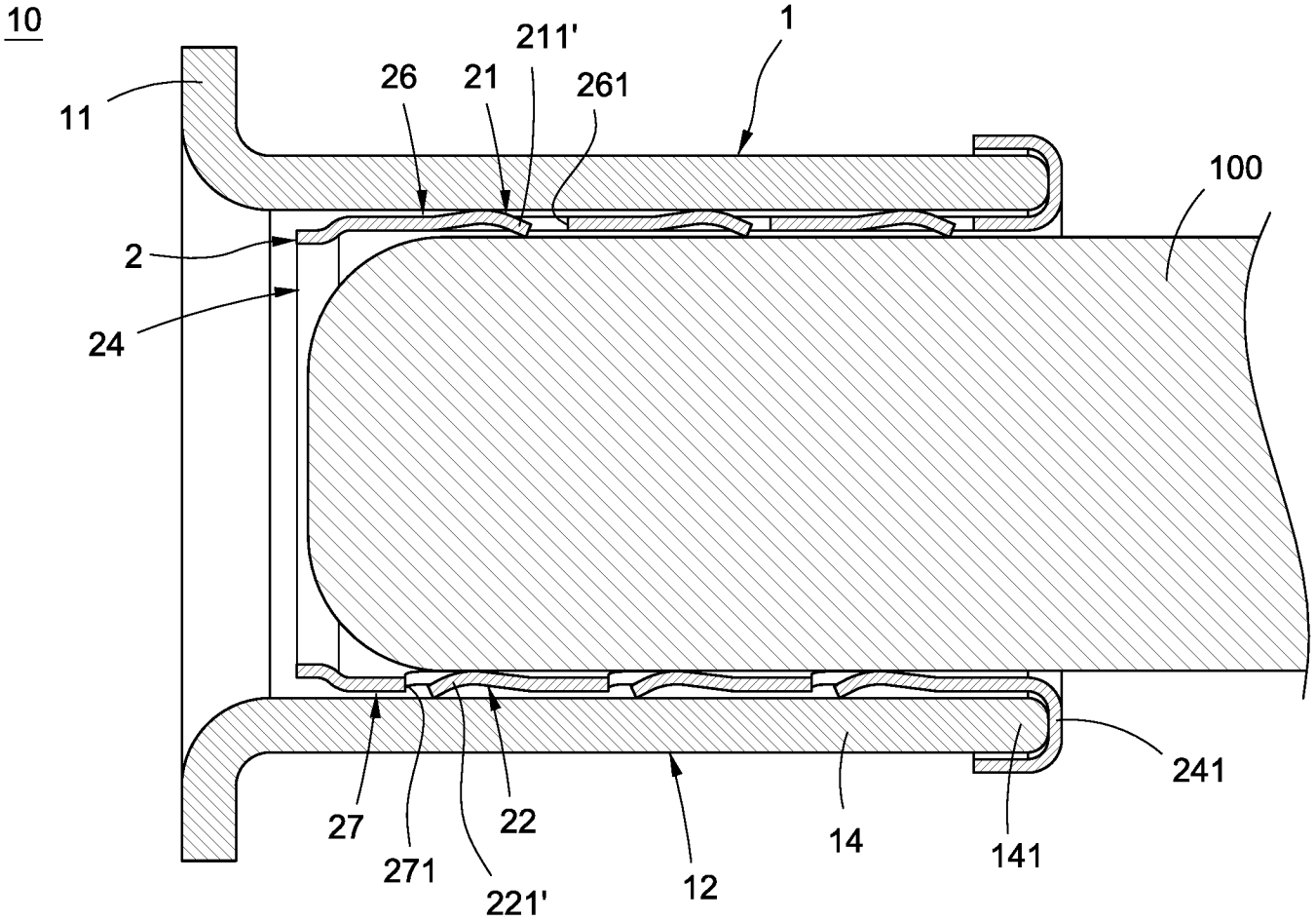
FIG. 12 is an operational view of the connector according to the fifth embodiment of the present invention.

Please refer to FIGS. 11 and 12, which show the connector 10 and the conductive spacer 2 according to the fifth embodiment of the present invention. The fifth embodiment is similar to the first embodiment. The difference between the first and the fifth embodiments is that the main bodies 1 and the conductive spacers 2 of these two embodiments have different structures.

The detailed description is given below. The pluggable portion 12 is a tube connector 14 and the conductive spacer 2 is an annular sheet body 24 fitting the tube connector 14. The tube connector 14 has an annular edge 141. The annular sheet body 24 has a folded ring portion 241 which is disposed at an end thereof and is bent to surround and press against the annular edge 141 such that the conductive spacer 2 can be fixed firmly to the pluggable portion 12.

Further, each of the first sections 26 is provided with a plurality of first openings 261; each of the second sections 27 is provided with a plurality of second openings 271. The outer projections 21 are a plurality of outer bent projections 211' which are formed in the first sections 26 and extend into the first openings 261. The inner projections 22 are a plurality of inner bent projections 221' which are formed in the second sections 27 and extend into the second openings 271. Thus, the shapes of the outer bent projections 211' and the inner bent projections 221' generate spring force, which have the same function and effect as the first embodiment.

In summary, the connector used with a high-current terminal of the present invention is not anticipated by the similar products and is not used in public. Also, it is indeed novel, useful, and non-obvious to be patentable. Please examine the application carefully and grant it as a formal patent for protecting the rights of the inventor.

What is claimed is:

1. A connector used with a high-current terminal (100), comprising:

a main body (1) having a connecting portion (11) disposed at one end thereof and a pluggable portion (12) disposed at the other end thereof, wherein the high-current terminal (100) is plugged into the pluggable portion (12); and a conductive spacer (2) disposed between the pluggable portion (12) and the high-current terminal (100), wherein the conductive spacer (2) is a U-shaped sheet body (23) having two wavy-shaped side plates parallel to each other, and each of the two wavy-shaped side plates has a plurality of wavy portions and a plurality of flat portions (25), and a plurality of through holes are formed on the plurality of wavy portions; wherein the plurality of wavy portions have a plurality of outer projections (21) pressed against the pluggable portion (12) and a plurality of inner projections (22) pressed against the high-current terminal (100).

2. The connector used with a high-current terminal (100) according to claim 1, wherein the pluggable portion (12) is a U-shaped clamp (13), wherein the conductive spacer (2) fits the U-shaped clamp (13).

3. The connector used with a high-current terminal (100) according to claim 2, wherein the U-shaped clamp (13) has two end edges (131) disposed in parallel with each other, wherein the U-shaped sheet body (23) has two ends bent to form two hook portions (231) surrounding and pressing against the two end edges (131).

4. The connector used with a high-current terminal (100) according to claim 1, wherein the pluggable portion (12) is a tube connector (14), wherein the conductive spacer (2) is an annular sheet body (24) fitting the tube connector (14).

5. The connector used with a high-current terminal (100) according to claim 4, wherein the tube connector (14) has an annular edge (141), wherein the annular sheet body (24) has a folded ring portion (241) which is disposed at an end thereof and is bent to surround and press against the annular edge (141).

6. The connector used with a high-current terminal (100) according to claim 1, wherein the plurality of flat portions (25) are disposed longitudinally and in parallel, and the conductive spacer (2) further has a plurality of first sections (26) and a plurality of second sections (27), wherein the first sections (26) and the second sections (27) are interlaced with each other and disposed between the flat portions (25).

7. The connector used with a high-current terminal (100) according to claim 6, wherein the outer projections (21) are a plurality of outer bent projections (211) which are formed in the first sections (26) and integrally connected between the flat portions (25), wherein the inner projections (22) are a plurality of inner bent projections (221) which are formed in the second sections (27) and integrally connected between the flat portions (25).

8. The connector used with a high-current terminal (100) according to claim 6, wherein the outer projections (21) comprise a plurality of first outer bent projections (212) which are formed in the first sections (26) and are integrally connected between the flat portions (25) and a plurality of second outer bent projections (213) which are formed in the first sections (26) and extend from a side of the flat portions (25), wherein the inner projections (22) comprise a plurality of first inner bent projections (222) which are formed in the second sections (27) and integrally connected between the flat portions (25) and a plurality of second inner bent projections (223) which are formed in the second sections (27) and extend from a side of the flat portions (25), wherein the first outer bent projections (212) and the second outer bent projections (213) are interlaced with each other and the first inner bent projections (222) and the second inner bent projections (223) are interlaced with each other.

9. The connector used with a high-current terminal (100) according to claim 6, wherein the outer projections (21) comprise a plurality of first outer bent projections (212') which are formed in the first sections (26) and integrally connected between the flat portions (25) and a plurality of second outer bent projections (213') which are formed in the second sections (27) and integrally connected between the flat portions (25), wherein the inner projections (22) comprise a plurality of first inner bent projections (222') which are formed in the first sections (26) and integrally connected between the flat portions (25) and a plurality of second inner bent projections (223') which are formed in the second sections (27) and integrally connected between the flat portions (25), wherein the first outer bent projections (212') and the first inner bent projections (222') are interlaced with each other and the second outer bent projections (213') and the second inner bent projections (223') are interlaced with each other.

10. The connector used with a high-current terminal (100) according to claim 6, wherein the outer projections (21) comprise a plurality of first outer bent projections (212") which are formed in the first sections (26) and integrally connected between the flat portions (25) and a plurality of second outer bent projections (213') which are formed in the second sections (27) and extend from a side of the flat portions (25), wherein the inner projections (22) comprise a plurality of first inner bent projections (222") which are formed in the first sections (26) and extend from a side of the flat portions (25) and a plurality of second inner bent projections (223") which are formed in the second sections (27) and integrally connected between the flat portions (25), wherein the first outer bent projections (212") and the first inner bent projections (222") are interlaced with each other and the second outer bent projections (213") and the second inner bent projections (223") are interlaced with each other.

11. The connector used with a high-current terminal (100) according to claim 6, wherein each of the first sections (26) is provided with a plurality of first openings (261), wherein each of the second sections (27) is provided with a plurality of second openings (271), wherein the outer projections (21) are a plurality of outer bent projections (211') which are formed in the first sections (26) and extend into the first openings (261), wherein the inner projections (22) are a plurality of inner bent projections (221') which are formed in the second sections (27) and extend into the second openings (271).

* * * * *